United States Patent [19]

Totsu

[11] 4,231,270

[45] Nov. 4, 1980

[54] ELECTRICALLY DRIVEN FASTENING APPLIANCE

[76] Inventor: Katsuyuki Totsu, No. 1-17-8, Higashi-Mukojima, Sumida-ku, Tokyo, Japan

[21] Appl. No.: 922,127

[22] Filed: Jul. 5, 1978

[30] Foreign Application Priority Data

Jul. 7, 1977 [JP] Japan ..... 52-81381
Sep. 13, 1977 [JP] Japan ..... 52-109444

[51] Int. Cl.[3] ..... B25D 23/142

[52] U.S. Cl. ..... 81/474; 64/29; 192/150

[58] Field of Search ..... 81/52.4 R, 52.4 A, 52.4 B, 81/52.5, 57.31, 57.11, 57.14; 192/150; 64/29

[56] References Cited

U.S. PATENT DOCUMENTS

| | | | |
|---|---|---|---|
| 2,209,155 | 7/1940 | Fagg | 192/150 |
| 3,277,670 | 10/1966 | Bent | 64/29 |
| 3,319,494 | 5/1967 | Ulbing | 81/57.31 |
| 3,906,819 | 9/1975 | Curtis | 81/52.4 R |
| 3,942,398 | 3/1976 | Fletcher et al. | 81/57.31 |

*Primary Examiner*—James L. Jones, Jr.

[57] ABSTRACT

An electrically operated fastening appliance with an automatic controlling clutch mechanism by which on termination of the fastening operation the power transmission from the motor (13) to the driving spindle (36) is instantly discontinued to prevent application of the excessive torque to the screw-threaded connecting means to be tightened and transmission of undesired reversing torque.

The automatic controlling clutch mechanism includes a central gear (40) secured to a drive shaft (38) derived from the motor (13), planetary gears (30) supported on a planet carrier (32) and an annulus member (29) with an internal gear (28) accommodated turnably in a cylindrical casing (14) and clutch elements interposed between the annulus member (29) and the casing (14).

6 Claims, 7 Drawing Figures

ELECTRICALLY DRIVEN FASTENING APPLIANCE

BACKGROUND OF THE INVENTION

The invention relates to an electrically driven fastening appliance having a clutch mechanism for automatic torque control to discontinue further power transmission from a power source to a driving spindle on receiving a predetermined torque.

Hitherto there were provided and used electrically operated screwdrivers of the type in which an electric motor as power source is located in a grip housing to transmit an output thereof to a driving spindle through a gear system such devices are known from the British Pat. Nos. 853,407 and 1,121,782.

In the tightening operation of a screw-threaded connecting means, such as a screw, with use of an electrically driven screwdriver of the type heretofore used, the total amount of torque to be applied to the screw head just before termination of the tightening operation includes the net motor output increased by the gear system and a kinetic inertia accumulated in accordance with revolutions of the rotor and the rotating elements of the gear system. While the net output component to be derived from the motor is usually constant, the amount of the kinetic inertia depends on the velocity of the rotating elements and is complicatedly variable due to different conditions such as shape and size of the screw shank, hardness of the base material and degree of tightening resistance. The amount of the kinetic inertia in terms of torque also varies in proportion to the square of the turning speed of the driving spindle. Hence an assumption of the amount of the kinetic inertia to be generated in each intended driving operation is difficult. Moreover, although there have been provided various torque controlling means responsive to the output of the motor, unanticipated excessive tightening torque is still generated, as a result of which damage to the screw and also the base material occurs.

In consideration of the foregoings, it has been determined that the exact torque controlling might be achieved by eliminating or possibly reducing undesired impact torque to be generated by accumulation of unstable kinetic inertia to derive an anticipative normal motor output torque. For example, when a screw-threaded connecting means such as a screw is tightened by a certain fastening appliance such as an electrically driven screwdriver, undesired kinetic inertia component only is removed from the total amount of the tightening torque to be applied, just before termination of the tightening operation to the screw head including a normal output component to be derived from the motor driving source plus undesired operation inertia to be added by the motor driving, so that only the normal output torque to be derived from the driving power source may be transmitted to the screw head to operate the clutch mechanism with the reversing torque of an amount equivalent to the output torque thereby to perform an automatic control of the torque.

After extensive studies it has been conceived that a substantial amount of the total reversing torque developed just before termination of the tightening operation may be converted into an energy sufficient enough to start another stationary element to turn, so as to substantially absorb the impace force. As the stationary elment an internal gear constituting a part of a planetary gear train may preferably be utilized to provide a novel torque controlling clutch assembly.

SUMMARY OF THE INVENTION

According to the present invention the novel torgue gear fixed to a motor drive shaft and three intermediate or planetary gears supported by a planet carrier to receive the power transmission from the central gear for rotation and revolution in mesh with an internal gear of a rotatable annulus member which is closed at one end to form a clutch face. A pocket is provided in the clutch face to receive a roller clutch member. The annulus member is rotatable accomodated in a cylindrical casing also having a closed end provided with an opening for receiving a ball clutch member which is resiliently urged against the clutch face by means of an external compression means such as an adjustable helical spring.

In accordance with the so devised torque controlling mechanism, the annulus member having the internal gear is normally fixed in relation to the cylindrical casing by means of the clutch ball member during the normal performance of the power transmission since the resistance against the screwing operation (before termination of the tightening operation of the screw) is relatively small. However when the tightening operation of the screw is brought to termination, the external resistance is increased abruptly with proportional increase of the reversing torque which is applied to the internal gear through the planetary gears resulting in a tendency to turn the internal gear in reverse of the rotation of the central or sun gear. Thus the annulus member is caused to be rotated in the cylindrical casing by overcoming the urging force of the ball clutch member.

Namely, the annulus member with the internal gear is released from fixed relation to the cylindrical casing by disengagement of the ball and roller clutch members and is permitted to freely rotate i.e., idle in the casing so that the power transmission from the power source to the driving spindle through the planetary gear train is discontinued instantly.

When the internal gear is caused to rotate under the function of the applied reversing load, the kinetic inertia energy accumulated in the turning elements such as the rotor of the motor, the sun gear and the other rotary elements in the planetary gear train, is substantially converted into an energy sufficient enough to start the annulus member rotatably from its stationary position. Thereafter rotation of the internal gear takes place by receiving the continuous normal output derived from the motor plus any unconsumed residual kinetic inertial energy and resists to the urging force of the ball clutch member. Thus, undesired kinetic inertial energy is substantially converted into the starting energy for the internal gear until the roller clutch member is passed on the ball clutch member, so that the torque may substantially be controlled to the degree near the normal motor output.

It is, therefore, a general purpose of the invention to provide an electrically operated fastening appliance with an automatic controlling clutch mechanism by which on termination of the fastening operation the power transmission from the motor to the driving spindle is instantly discontinued to prevent application of the excessive torque to the screw-threaded connecting means to be tightened and transmission of undesired reversing torque.

In another aspect of the present invention, the torque controlling mechanism is provided with an automatic power breaking system responsive mechanically to the idling operation of the internal gear to automatically interupt the current supply to the motor.

In the torque controlling mechanism as hereinbefore described, the power transmission from the motor drive shaft to the driving spindle is mechanically discontinued instantly on termination of the fastening operation to prevent an application of an excessive kinetic inertia to the fastening object such as the screw as well as to absorb undesired reversing torque. However, since the motor remains in place for operation with continuous idling motion of the annulus member in friction with an inner wall of the cylindrical casing a generation of undesired offensive metallic noise may occur. This undesired situation may be eliminated manually by the operator in sensing the idling motion of the annulus member of the internal gear and operating a convenient switch to cut off the current supply to the motor. However, it requires a skilled technique. Because, however, many difficulties occur in attempting to minimize the friction noise between the annulus member and the external casing.

To overcome the foregoing disadvantage and inconvenience, it has been conceived that an idling motion of the annulus member with the internal gear may be mechanically measured through a downward movement of the ball clutch member and employed to interrupt the current supply to the motor.

Therefore, according to the present invention the axially slidable flanged sleeve mounted around the spindle bearing and engageable with an on-off switch means may be made a spring means is mounted around the flanged sleeve switch means.

BRIEF DESCRIPTION OF THE DRAWINGS

The invention is described in detail below with reference to the accompanying drawings which.

DESCRIPTION OF THE INVENTION

Figure 1:
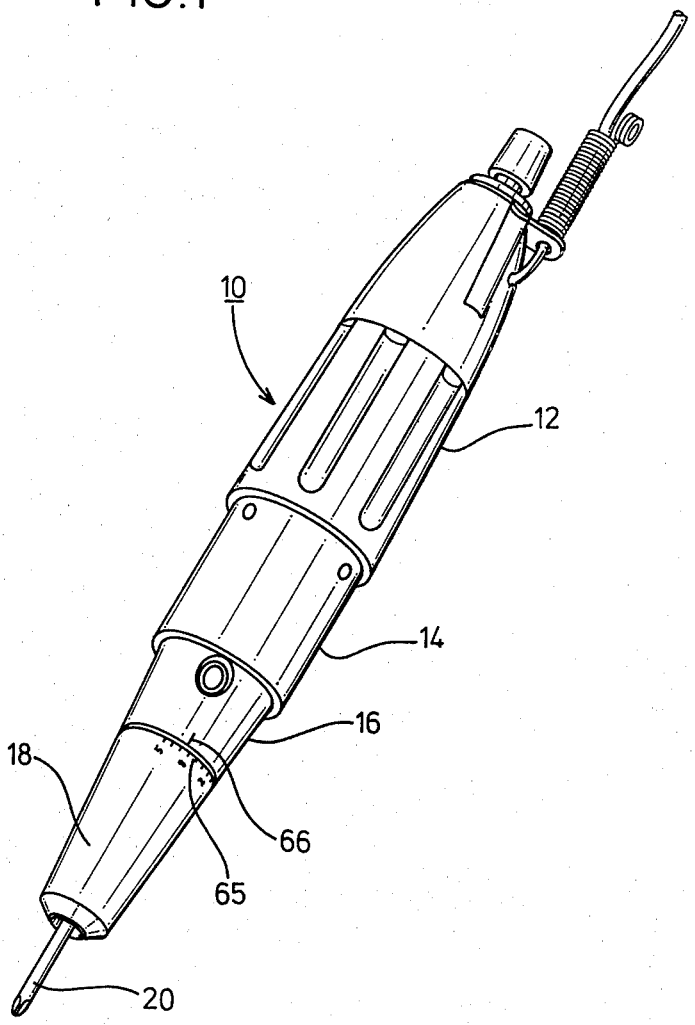
FIG. 1 is a perspective view of an electrically driven screw driver unit with an automatic torque controlling assembly according to the invention.
Figure 2:
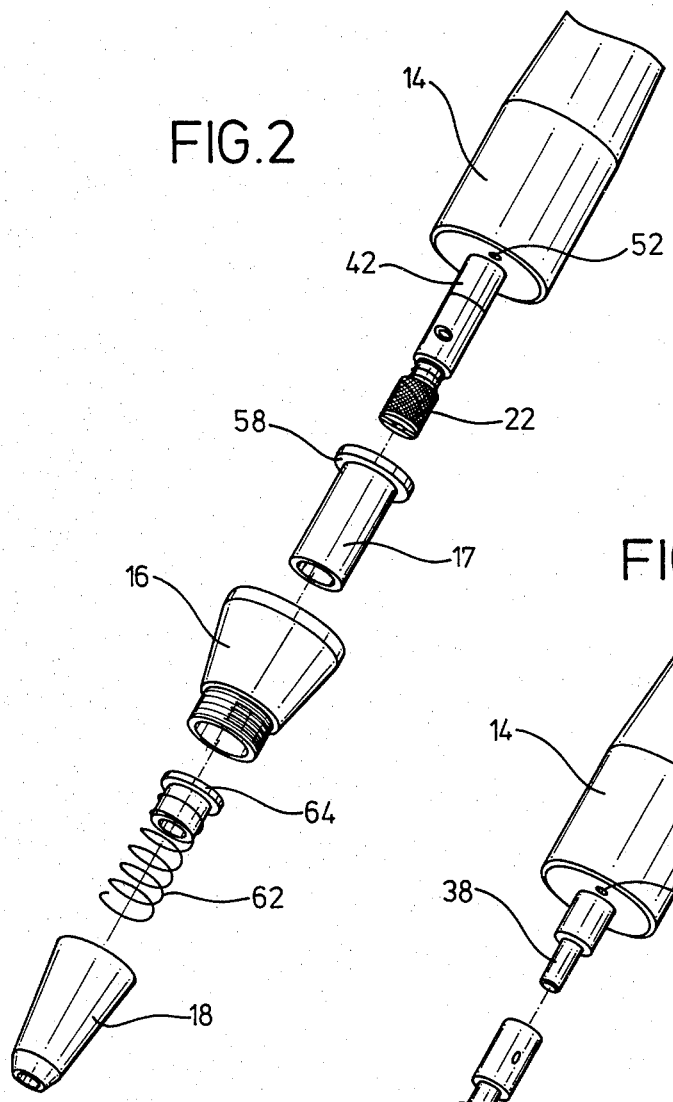
FIG. 2 is an exploded view of the screwdriver unit of FIG. 1.
Figure 3:
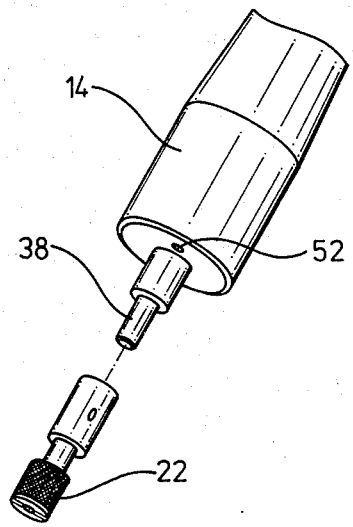
FIG. 3 is a partially exploded view of the screwdriver unit of FIG. 2.

In FIG. 1, an electrically operated screw driver is formed with a housing 10 which includes a gripping portion 12 in which a motor 13 is accommodated, a cylindrical casing 14 in which a gear assembly 15 is accommodated, a truncated conical sleeve cover 16 and an adjustable cap member 18. The cap member 18 has the function of covering a clamping chuck 22 which releasable holds a driver bit 20 as best shown in FIG. 2 which illustrates the exploded positions of the cap 18, the sleeve cover 16 and a flanged sleeve 17 removed from the casing 14.

The clamping chuck 22 is mountd on a driving spindle 36 extending from the gear assembly 15 accommodated in the casing 14. A hole 23, for a set screw is provided on the chuck shaft coupling for securing the chuck to the driving spindle 36. The cover 16 is provided with a hole 25 for the chuck key. The gear assembly is typically comprised of an internal gear 28 provided along an inner circumference of an annulus member 29 and planetary gears 30 which are supported on a disc carrier 32 through axles 34 to coact with the internal gear 28 for rotation and revolution. The disc carrier 32 is secured to the driving spindle 36. The planetary gears 30 further coact with a central gear 40 secured to a motor shaft 38 extending from the motor 13. The driving spindle 36 is rotatably carried by a bearing 42 integrally formed with the casing 14. Thus, it will be appreciated that when the internal gear 28 is in a fixed relation to the casing 14 the turning torque of the motor 13 is transmitted through the central gear 40, the planetary gears 30 and the internal gear 28 to the driving spindle 36.

Figure 6:
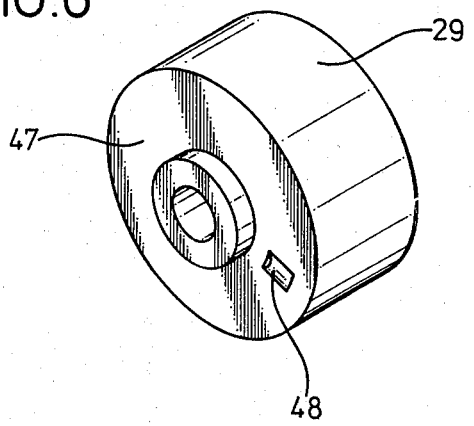
FIG. 6 is a perspective view of the internal gear member incorporated into the torque controlling assembly.

As best shown in FIG. 6, the annulus member 29 including the internal gear 28 is closed at its one end to form a clutch face 47 in which a radially extended pocket 48 is provided to receive a roller clutch member 49.

Figure 4:
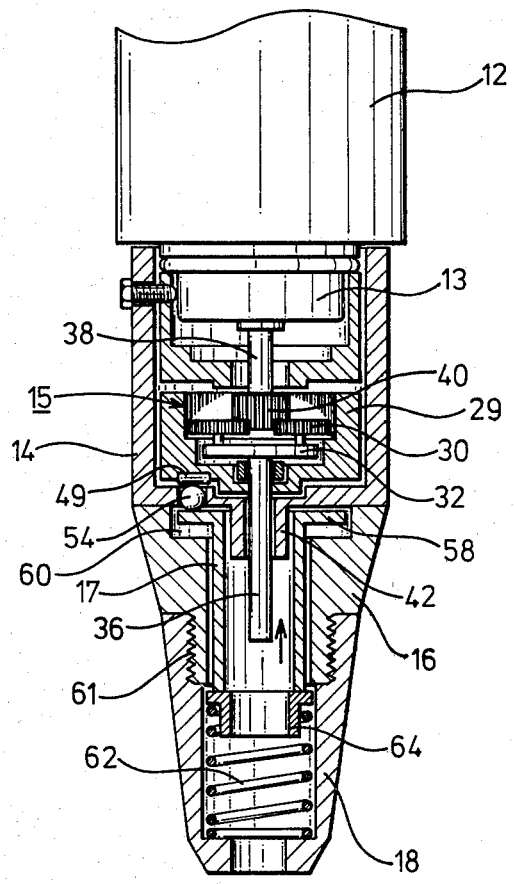
FIG. 4 is a longitudinally sectioned view of the automatic torque controlling assembly according to the invention.
Figure 5:
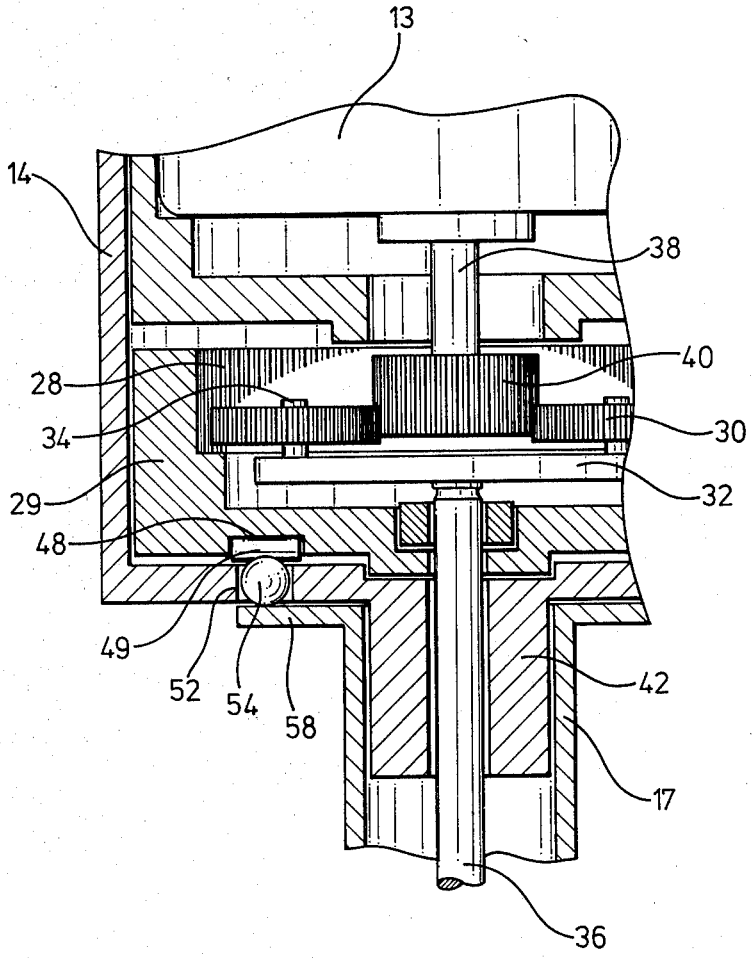
FIG. 5 is a fragmentarilly enlarged sectional view of the automatic torque controlling assembly of FIG. 4.

In FIGS. 4 and 5, the casing 14 at its lower end is closed but is provided with an opening 52 for receiving a ball clutch member 54. The ball clutch member 54 is of the size which permits passing of the ball 54 through the opening 52 although the ball 54 is partially exposed from the opening 52 as best shown in FIG. 4.

A flanged sleeve 17 is mounted coaxially and movably around the spindle bearing 42 to resiliently support the ball clutch member 54 on its flange portion 58 under a function of the spring 62 as hereinafter described. The flanged sleeve 17 is loosely encircled by the sleeve cover 16 which is in turn fixed to the casing 14 by means of a convenient fastening means. Further, the flange 58 of the sleeve 17 is loosely received in an annular chamber 60 provided in the inner end of the sleeve cover 16. The opposite end of the sleeve 17 is somewhat extended from the opposite end of the cover 16 which is provided with a threaded end 61 to which the cap member 18 is threadedly connection. In the cap member 18 there is mounted a helical spring 62 which abuts at one end with a ring member 64 at its other end with the cap 18 so as to be urged in the axial direction against the ring 64. Thus, it will be appreciated that when the cap member 18 is threadedly connected to the sleeve cover 16 the end of the flanged sleeve 17 extended from the threaded end 61 of the sleeve cover 16 is made to bear into contact with the ring member 64 so that the flanged sleeve 17 is compelled to slide inwardly in the direction shown by the arrow in FIG. 4 under the function of the spring 62. Consequently, the flange portion 58 of the sleeve 17 carries the ball clutch member 54 in the opening 52 and urges the same upwardly against the clutch face 47 of the internal gear 28. When the urging force of the helical spring 62 is greater than the reversing torque applied to the internal gear 28, the ball clutch member 54 is intensively urged by the flange portion 58 of the sleeve 17 to discontinue further turning of the roller clutch member 49 so that the annulus member 29 with the internal gear 28 is fixed stationarily in relation to the casing 14. Thus, the increased driving power of the central gear 40 is directly transmitted to the driving spindle 36.

The tightening operation of the screw takes place with the internal gear 28 in its fixed position, and the output from the power source is transmitted to the driving spindle 36 and the bit 20. When the tightening operation of the screw is brought to termination and the screwing in operation of the screw ceases abruptly, the reversing load or torque is transmitted, in reverse through the driver bit 20—the driving spindle 36—the disc carrier 32—the planetary gears 30—the internal gear 28—the roller clutch member 49—the ball clutch member 54—the casing 14 in order. When the reversing load or torque exceeds a predetermined moment the roller clutch member 49 received in the pocket 48 of the annulus member 29 is urged to the opposite direction in resistance to the force of the spring 62 until the reversing load or torque overcomes the spring force. Then the flanged sleeve 17 supporting the ball clutch member 54 is retarded or depressed downwardly i.e., into the cap 18 before the roller clutch member 49 passes across the ball clutch member 54. As a result the internal gear 28 becomes free in relation to the casing 14 so that it can smoothly rotate therein. Consequently the power transmission from the central gear 40 is discontinued terminating the rotation of the driving spindle 36.

As soon as the reversing torque is applied to the driving spindle 36 the internal gear 28 is brought to idling within the casing 14 with an instant standstill of the power transmission. Since the internal gear 28 is arranged in the casing 14 to turn freely therein as hereinbefore described, the internal gear 28 is accurately responsive to the reversing torque only, while, the motor per se is still left for the normal turning operation without receiving any excessive load, so that the reversing torque is consumed as a power for idling the internal gear 28. As a result less reaction is transferred to the operator with less mental fatique but with considerable increase of the working efficiency.

A selective adjustment of the reversing torque to be applied to the internal gear 28 for idling thereof may be obtained by turning the cap member 18 to adjust an elasticity of the spring 62. As shown in FIG. 1, the cap member 18 is provided with a calibration 65 whereas the sleeve cover 16 is provided with an indicating line 66 to index the value of the reversing torque.

Figure 7:
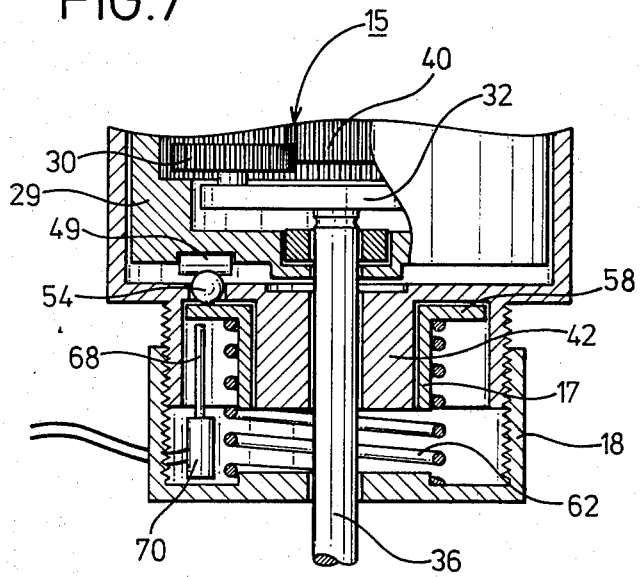
FIG. 7 is a sectional view of a modification of the torque controlling mechanism which includes an automatic power breaking system according to the invention.

In the embodiment of FIG. 7, the flanged sleeve 17 is depressed downwardly when the reversing torque overcomes the spring action of the helical spring 62 to engage with a lever 68 of a micro switch 70 in which the current supply to the motor 13 may be cut off. As hereinbefore described, the flanged sleeve 17 is depressed by the ball clutch member 54 when the roller clutch member 49 passes thereon.

According to this second embodiment of the invention, the internal gear 28 is turned upon receiving the reversing torque to terminate the power transmission and also the rotation of the internal gear is mechanically measured to cut off the current supply to the motor, hence any generation of undesired offensive metalic noise to be caused by idling of the internal gear after termination of the tightening operation may positively be avoided.

The foregoing is to be considered as descriptive and not limitative as many changes and modifications can be made therein without departing from the concept of the invention.

I claim:

1. A power fastening tool comprising a housing closed at one end, a tool driving spindle journalled at said closed end and extending outwardly therefrom, an electric motor mounted in said housing and having the drive shaft extending therefrom and an automatic clutch control planetary gear system interconnecting said motor drive shaft and said spindle, said gear system comprising a central gear fixed to said motor drive shaft, a plurality of planetary gears arranged around said central gear supported on a planet carrier connected to said spindle and drivable by said central gear and an annulus member having an internal gear which coacts with the planetary gears for revolution about the central gear, said annulus member having one end closed to form a face in opposition to the closed end of said housing, said annulus face and said closed end being provided with resiliently engagable clutch means operating to respectively maintain said annulus member stationary relative to said housing on application of a first torque not exceeding a predetermined level and to permit rotation of said annulus member with respect to said housing on application of a second torque greater than said predetermined level.

2. The tool according to claim 1 wherein said clutch means comprises a roller member and a ball member mounted on the opposing faces of said annulus member and said closed end of said housing respectively.

3. The tool according to claim 2 wherein the face of said annulus member is provided with a radially extending pocket for receiving said roller and said closed end of said housing is provided with an opening aligned therewith for receiving said ball.

4. The tool according to claim 3 including an axially movable sleeve surrounding said spindle extending beyond the closed end of said housing, said sleeve having a radially outwardly extending flange adapted to engage the balls of said closed end and spring means for urging said sleeve against said ball to thereby resiliently urge said ball against the face of said annulus member.

5. The tool according to claim 4 including an on-off switch connected operatively to said motor and mounted for engagement by the flange of said sleeve on axial movement of said sleeve to thereby control said motor.

6. The tool according to claim 4 or 5 including a cap removably secured to said housing and covering the extending spindle and sleeve, said spring comprising a compression spring abutting at one end against said cap and at its other end against said sleeve.

* * * * *